US007140644B2

(12) United States Patent
Hanes

(10) Patent No.: US 7,140,644 B2
(45) Date of Patent: Nov. 28, 2006

(54) TABBED INDEX DIVIDER ASSEMBLY AND KIT

(76) Inventor: Kenneth J. Hanes, 2403 Constellation Dr., Colorado Springs, CO (US) 80906

( * ) Notice: Subject to any disclaimer, the term of this patent is extended or adjusted under 35 U.S.C. 154(b) by 24 days.

(21) Appl. No.: 10/966,664

(22) Filed: Oct. 18, 2004

(65) Prior Publication Data

US 2006/0082132 A1 Apr. 20, 2006

(51) Int. Cl.
*B42F 21/00* (2006.01)

(52) U.S. Cl. ..... 283/36; 402/73

(58) Field of Classification Search ..... 283/36–42; 402/73, 79

See application file for complete search history.

(56) References Cited

U.S. PATENT DOCUMENTS 1,048,577 A * 12/1912 Pardoe, Jr. ..... 40/359
4,784,508 A * 11/1988 Shannon ..... 402/79
4,810,544 A * 3/1989 Hickman ..... 428/41.7
6,071,030 A * 6/2000 Hunter et al. ..... 402/79
6,648,374 B1 * 11/2003 Takemura ..... 283/36
6,851,718 B1 * 2/2005 Liener Chin et al. ..... 283/36

* cited by examiner

*Primary Examiner*—Monica Carter
*Assistant Examiner*—J Williams
(74) *Attorney, Agent, or Firm*—Richard W. Hanes; Hanes & Schutz, LLC

(57) ABSTRACT

A tabbed index divider assembly comprising a folded divider sheet having length and width dimensions where the sheet is folded along a line that bisects the length dimension, forming a folded outside edge and dual binding edges and having at least one slit in the folded outside edge, and an insert sheet having a tab edge with an index tab extending therefrom, said insert sheet sized and adapted to be secured between the folded halves of the divider sheet with the index tab inserted through the at least one slit in the folded outside edge of the divider sheet. The invention includes a method for making the index divider assembly and a kit having the components for assembling a plurality of index dividers.

15 Claims, 4 Drawing Sheets

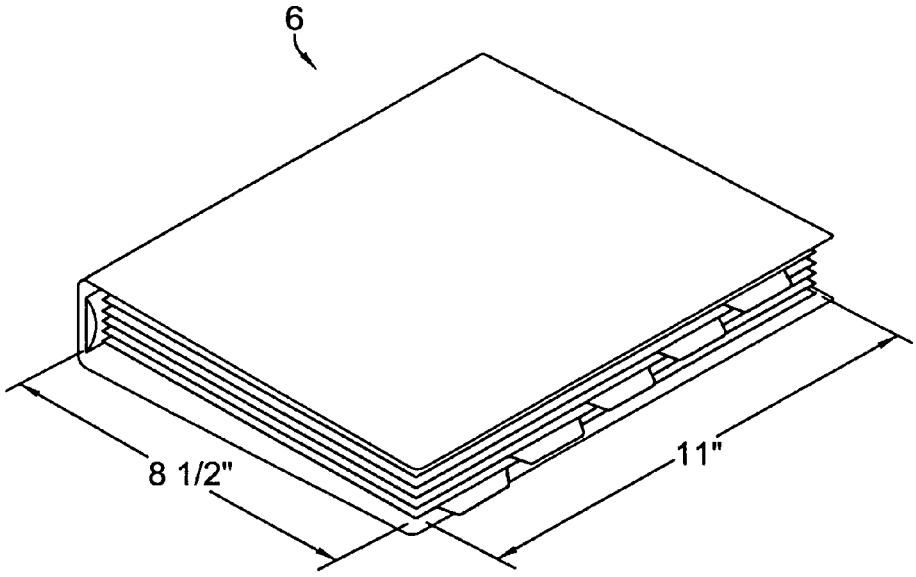
Fig. 1
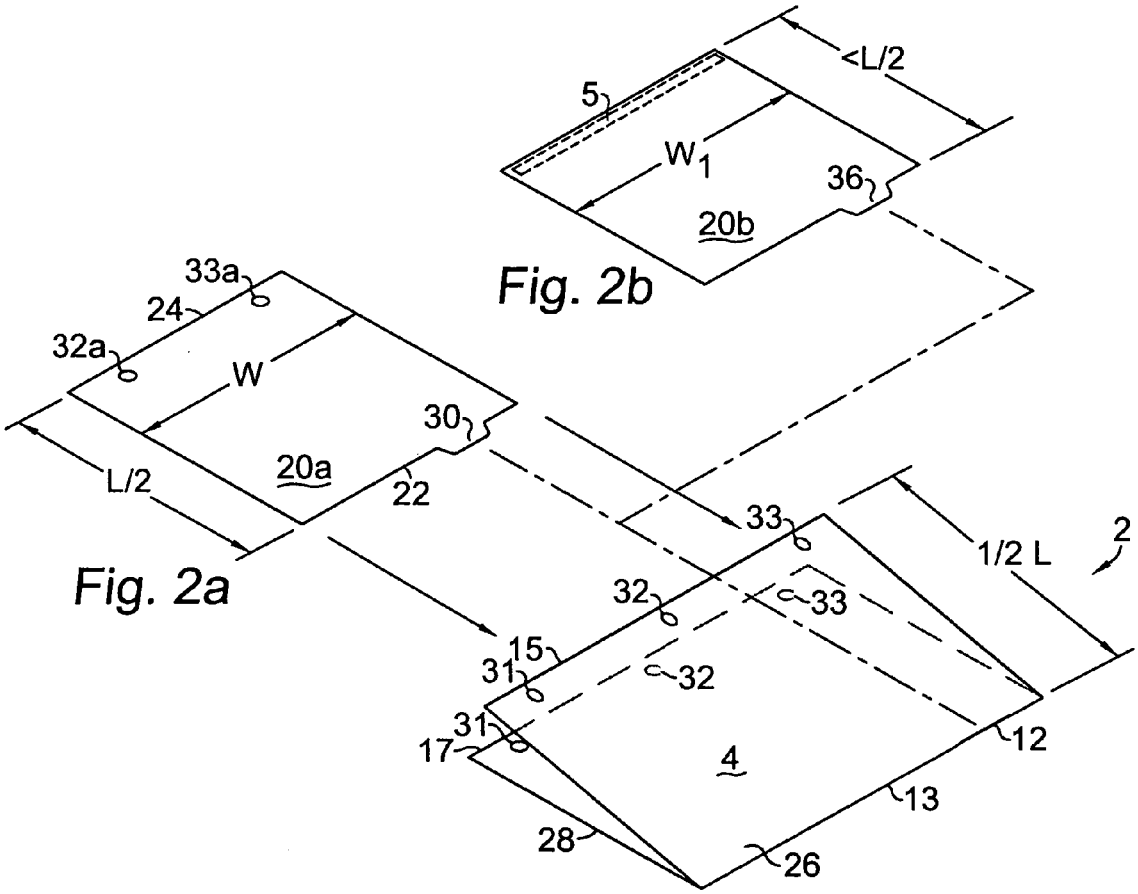
Fig. 2b
Fig. 2a
Fig. 2

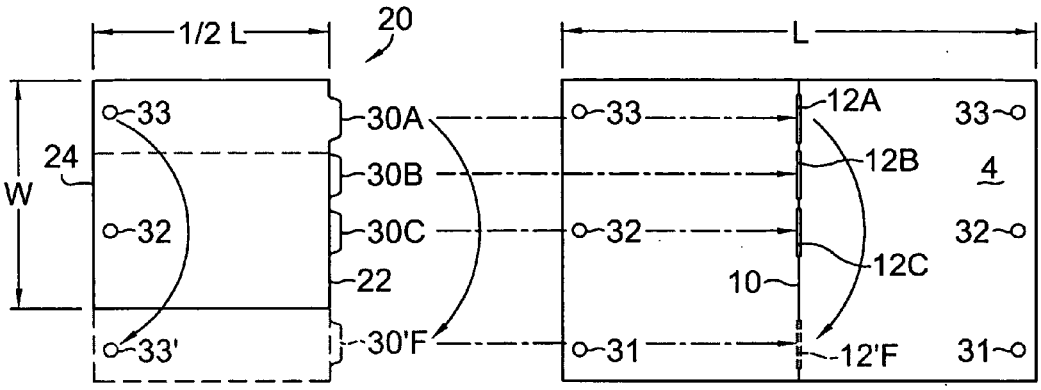
Fig. 6
Fig. 7
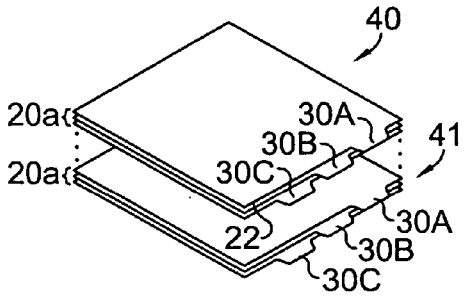
Fig. 8a
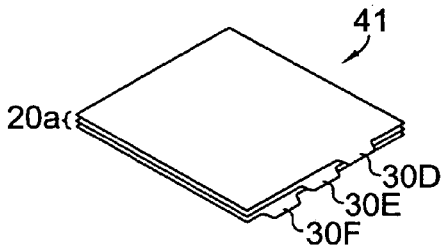
Fig. 8b
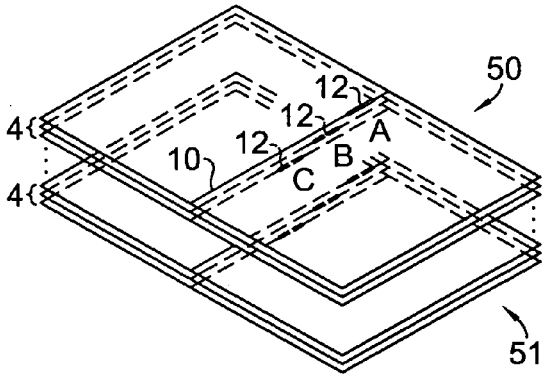
Fig. 9a
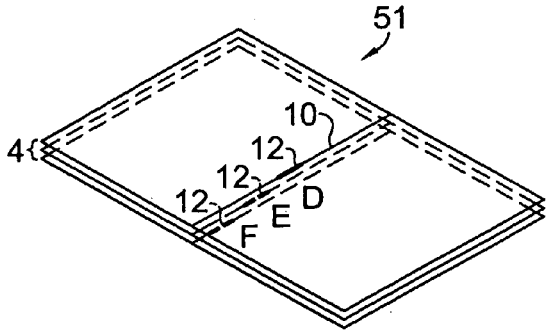
Fig. 9b

TABBED INDEX DIVIDER ASSEMBLY AND KIT

FIELD OF THE INVENTION

The present invention relates to index divider sheets and separate index tabs that are both directly printable by computer driven printers.

BACKGROUND OF THE INVENTION

Tabbed dividers for comb or spiral wire-bound books or for loose leaf ring binders are common commodities in any office supply store. The tabs may be pre-printed with general indicia, such as numbers or letters, or may be left blank for user designation. In the latter case it is often desirable to use a computer printer to print the information on the tab. In many cases it is also desired to print material on the divider sheet itself. In either case a tabbed 8½" wide sheet will not pass through the paper conveyance mechanism of a standard desktop type of printer, because the tab increases the width dimension beyond that which the printer will accommodate.

Dealing with the printing limitations imposed on tabbed divider sheets has been the subject of much effort that is memorialized in a number of U.S. Patents. Notable among these are U.S. Pat. Nos. 6,068,423, 6,099,189 and 6,361,639 to Owen and all of the patents cited and referred to therein by the Patentee. A somewhat similar configuration, also requiring folding and the use of adhesives, is disclosed in U.S. Pat. No. 6,089,777 to Wong. The Deutschmann U.S. Pat. No. 5,954,445, and the Mangler U.S. Pat. No. 6,039,354, are also directed to apparatus and methods for creating index sheets having perforations or foldable portions defining a guide, removable guide strips on the tab edge, foldable binding sides, hinged cutouts, removable index tab portions and the like, all of which are designed to allow the index sheet to pass, in a guided or controlled fashion, through a printer.

It is apparent from the continuing effort to improve the apparatus and process related to printing index tabs and index divider sheets with a standard computer printer that a satisfactory solution has yet to be developed.

It is therefore, the primary object of the present invention to provide a simplistic, cost effective and workable solution to the inability of computer printers to print traditionally formed index tabs or index divider sheets having protruding index tabs.

SUMMARY OF THE INVENTION

The tabbed index divider assembly of the present invention preferably comprises a folded rectangular divider sheet having a length and a width and where the sheet is folded along a line that bisects its length dimension, forming a folded outside edge and dual sheet binding edges. A slit having the length of an index tab is located in the folded edge.

The second element of the assembly comprises a flat insert sheet having a tab edge with an integral, preferably die cut, planar index tab extending outwardly therefrom. The insert sheet is adapted to be disposed and secured between the folded halves of the divider sheet with the index tab inserted through and protruding from the slit in the folded edge of the divider sheet. The insert sheet is secured in position within the divider sheet by an adhesive, or preferably by a common binding with the divider sheet.

Prior to, or subsequent to folding of the divider sheet, one or both of its folded exterior surfaces may be printed by feeding the sheet through a printer, its width being such that it will be accommodated by a standard computer printer.

Prior to placing the insert sheet between the folded sides of the divider sheet, the insert sheet may be run through a printer to print indicia or information on the extended index tab. During the printing operation the tab is positioned on the trailing edge of the sheet as it is fed through the printer. In order to print the index tab, the width of the insert sheet, that is its dimension measured in a direction parallel to the binding edge of the divider sheet, should not exceed the width of documents that can be accommodated by a standard computer printer.

With the insert sheet placed within the folded divider sheet, the combined sheets may be hole punched for use in a ring binder or punched for a GBC comb binding. Binding holes may also be pre-punched in the divider sheet and the insert sheet.

In addition to the described assembly of a single divider sheet and its tabbed insert sheet, the invention also contemplates a kit containing a plurality of divider sheets and a plurality of index sheets. The components of the kit may be assembled into a number of indexed divider sheets having a bank of staggered index tabs for use in one or more books. In such a kit the insert sheets are each provided with die cut planar index tabs that are staggered in their respective positions along the tab edges of the index sheets. The plurality of divider sheets in the kit each contains a slit in its folded edge. The slits in the combination of divider sheets in the kit are also staggered to accommodate the staggered index tabs on the insert sheets to produce a bank of index tabs in a book that will contain the divider index sheets. However, instead of each divider sheet in the kit having one selectively positioned slit for a specifically positioned index tab on a particular insert sheet, an alternative kit embodiment is provided. The alternative embodiment includes divider sheets that have multiple slits to accommodate all possible tab bank configurations existing on the insert sheets within the kit.

The insert sheets and the slotted divider sheets may contain a number of different possible tab bank configurations, such as a four-tab bank, a six-tab bank, etc.

DESCRIPTION OF THE DRAWINGS

FIG. 1 is a perspective view of a typical book having divider sheets and index tabs.

FIG. 2 is a perspective view of a folded divider sheet in accordance with the present invention.

FIG. 2*a* is a perspective view of a preferred form of insert sheet of the present invention having width W and Length L/2 and having holes in the binding edge to receive the rings of a ring binder.

FIG. 2*b* is a perspective view of an alternate form of insert sheet having length less than L/2, and a width $W_1$ and having adhesive securing means.

FIG. 6 is a plan view of three stacked insert sheets, each having an index tab in a different location with the same three sheets shown by dashed lines in inverted positions.

FIG. 7 is a plan view of a divider sheet, similar to the illustration of FIG. 3, except that FIG. 7 illustrates a divider sheet having three slits and showing in dashed lines the position of the three slits when the divider sheet is inverted.

FIG. 8*a* is a perspective view of two sets of three insert sheets each, where each sheet has an index tab positioned differently from the position of the tabs on the other two sheets of the set.

FIG. 8*b* is a perspective view of one of the three-sheet sets of insert sheets shown in FIG. 8*a* in an inverted position in order to reposition the index tabs along the lengthwise edge of the papers or sheets in a book.

FIG. 9*a* is a perspective view of two sets of three divider sheets each, where each sheet has an index tab-receiving slit positioned differently from the position of the slits on the other two sheets of the set.

FIG. 9*b* FIG. 8*b* is a perspective view of one of the three-sheet sets of divider sheets shown in FIG. 9*a* in an inverted position in order to reposition the index tabs received in the slits.

DETAILED DESCRIPTION

Figure 3:
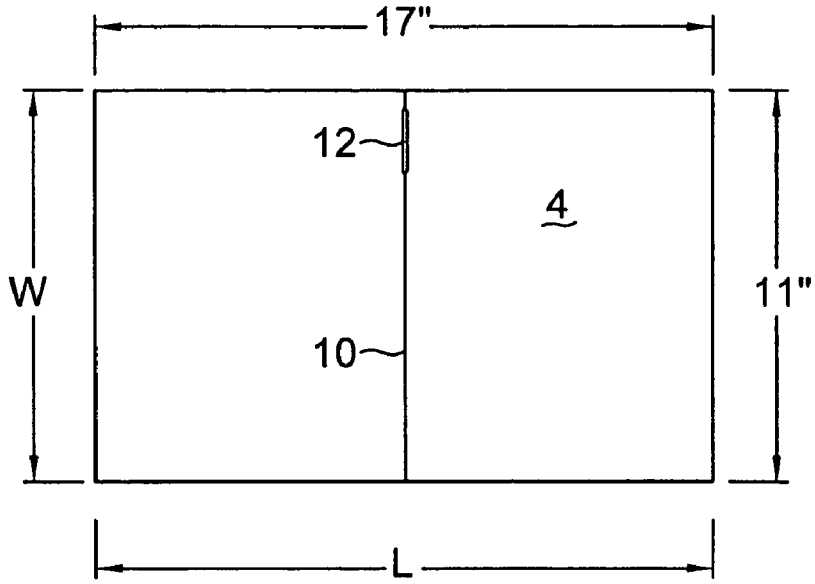
FIG. 3 is a plan view of an unfolded divider sheet of the assembly of the present invention showing dimensions, L=17" and W=11", applicable to use of the divider sheet with standard 8½"×11" book pages.

Specific dimensions are not part of the present invention, however because many prior art devices and the inventive apparatus are most often applied in the context of standard 8½"×11" letter sized paper, those dimensions will be used in the following description of the preferred and alternate embodiments of the invention. This description however does not preclude the application of the invention to A4 paper, legal or other size. While a three-ring binder is illustrated in the drawings, the invention can be utilized with all types of binders.

As illustrated in FIGS. 2, 2*a* and 2*b*, a single index divider assembly 2 in the preferred form of the present invention includes a folded divider sheet 4 of regular bond paper or preferably, a heavier cardstock. Assuming the divider assembly is to used in a typical book 6 (FIG. 1) containing 8½" wide and 11" long documents, the divider sheet 4 is formed from a 17"×11" piece of card stock, as shown in FIG. 3. The sheet is scored along a line 10 that bisects the sheet's long 17" dimension, L. In addition to scoring the sheet 4, a slit 12 is cut through the sheet along the scoring line 10. As seen in FIG. 2, the sheet 4 is folded along its central scoring line 10 to form folded halves 26 and 28 with an outside folded edge 13 and opposed inside binding edges 15 and 17.

As illustrated in FIG. 2*a*, an insert sheet 20*a* having a tab edge 22 and a binding edge 24 is adapted to be introduced between the folded halves 26 and 28 of the divider sheet 4. An index tab 30, integral with the insert sheet 20*a* and extending from its tab edge 22, is inserted through the slit 12 in the divider sheet 4 so as to extend beyond the folded edge 13 and be visible as an index tab when the divider sheet is assembled into a book. (See FIG. 4)

While the slit 12 that accommodates the index tab 30 is shown in the drawings as being toward one end of the divider sheet 4, it is to be understood that the slit can be placed at any position on the folded edge 13. The location of the index tab 30 on the insert sheet 20*a* or the lateral position of the insert sheet within the folded divider sheet 4 is selected so that the position of the index tab 30 matches the position of the slit 12 in the folded edge 13 of the divider sheet 4. A divider sheet may also be provided with more than one slit, as subsequently described with respect to the kit form of the present invention.

Figure 4:
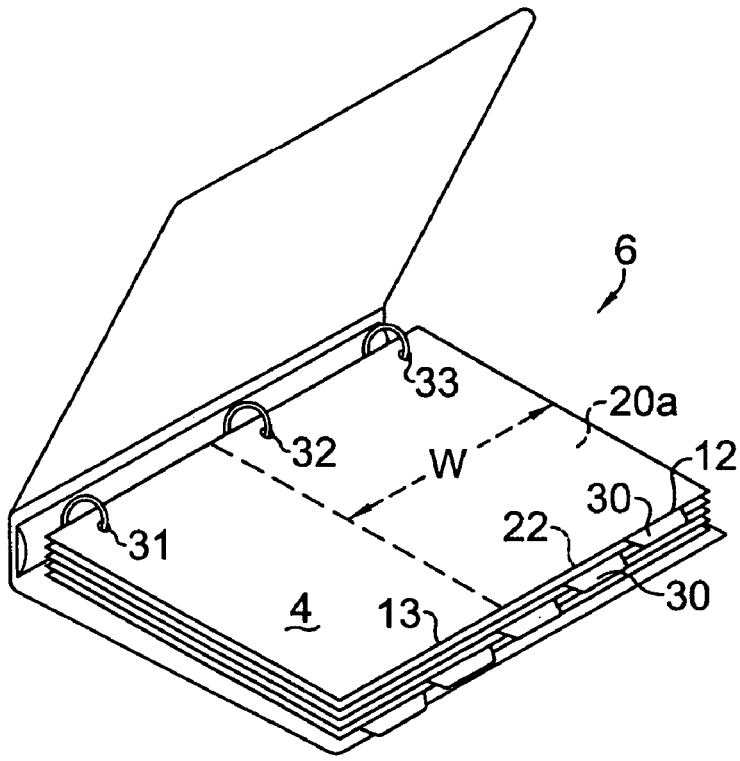
FIG. 4 is a perspective view of a book having a divider sheet assembly of the preferred form of the present invention as the first and subsequent pages of a three-ring bound book.

The insert sheet is preferably secured within the folded halves of the divider sheet by a common binding with the dual binding edges of the divider sheet. For example, when the divider sheet is to be used in a three-ring loose leaf notebook the binding edges 15 and 17 of the divider sheet and the binding edge 24 of the insert sheet 20*a* are punched together with ring accommodating holes 31, 32 and 33. Thus, the two holes 32*a* and 33*a* in the insert sheet are congruent with holes 32 and 33 in the divider sheet 4. When holes 32*a* and 33*a* of the insert sheet 20*a* are fastened together with holes 32 and 33 of the divider sheet respectively by the rings of a binder, the insert sheet is thus stabilized and secured within the folded divider sheet 4. The common binding also fixes the index tab 30 in a secure position within the slot 12 of the folded divider sheet 4, as shown in FIG. 4. The common binding can be a ring binder, a plastic comb binder, a wire spiral binding, a pin binding or thermal or adhesive binding.

In order for the binding edge 24 of the insert sheet 20*a* to be aligned with the binding edges 15 and 17 of the folded divider sheet 4, the length of the insert sheet must be one half of the total length of the divider sheet, or L/2. As will be explained, in order to print on the index tab 30 with a common computer printer, the width W of the insert sheet should not be over 8½ inches.

An alternative form 20*b* of an insert sheet is shown in FIG. 2*b* where an adhesive 5 adheres the binding edge 24 of the insert sheet to either one of the folded halves 26 or 28 of the divider sheet 4. In this embodiment, the length L of the insert sheet cannot be greater than L/2 but may be less than L/2. However, the width $W_1$ should not be greater than 8½ inches if it is intended to print the index tab 30 with an ordinary computer printer.

With this understanding of the basic structure and components of a preferred form of the divider sheet assembly 2 and preferred and alternate forms of insert sheets 20*a* and 20*b*, attention is now directed to additional details of the assembly.

Figure 5A:
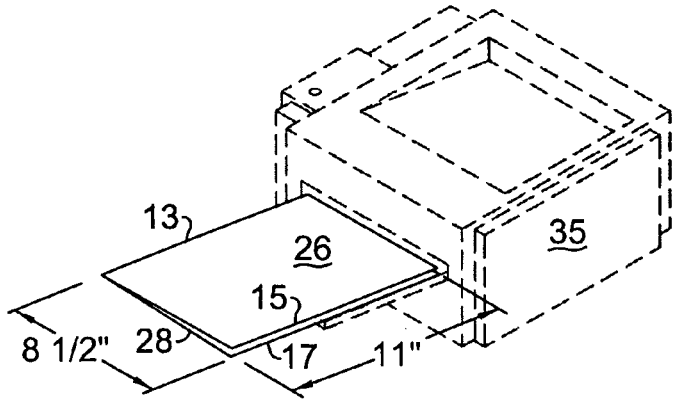
FIG. 5*a* is a perspective view of a folded divider sheet of the present invention being inserted into a standard 8½" wide computer printer.
Figure 5B:
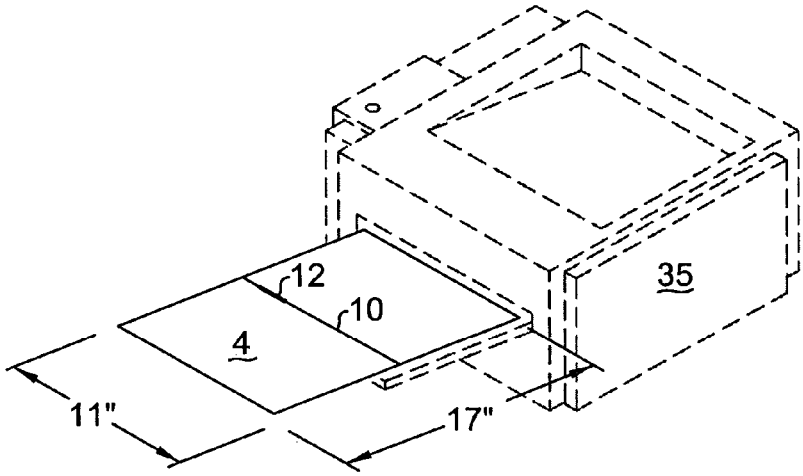
FIG. 5*b* is a perspective view of an unfolded divider sheet of the present invention inserted into an oversized computer printer.
Figure 5C:
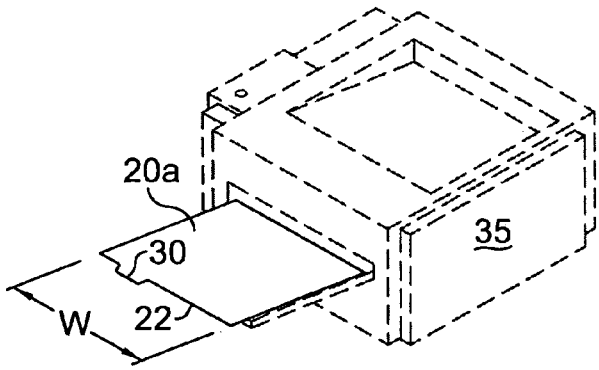
FIG. 5*c* is a perspective view of an insert sheet of the present invention with a trailing edge index tab being inserted into a standard 8½" computer printer.

Before introducing the insert sheet 20*a* or 20*b*, the folded divider sheet 4, having an 8½" width (17/2), may be fed through a computer printer 35 in order to print graphics or information on one or both sides of the folded divider sheet, as illustrated in FIG. 5*a*. The divider sheet may also be printed prior to folding, however a printer that will accommodate an 11" width of printing stock is required, as shown in FIG. 5*b*. Printing of the index tab 30 on an insert sheet 20*a*, or 20*b*, having a width of 8½" or less is illustrated in FIG. 5*c*.

Referring again to FIGS. 2*a* and 2*b*, the width W and $W_1$ of the insert sheets is chosen to permit either of the alternative insert sheets 20*a* or 20*b* to be fed through a standard computer driven desktop printer that accommodates printing stock having a maximum width of 8½" inches. With this, or a narrower width dimension, the insert sheets are fed through a computer printer 35 in order to print indicia or other information on the extended index tab 30. The tab 30, positioned on tab edge 22, trails as the insert sheet is fed into the printer 35, as shown in FIG. 5*c*.

Having described the preferred and possible alternative embodiments of a single tabbed divider sheet according to the present invention, attention is now turned to the advantages of the invention with respect to a kit or package of divider sheet components. Such a kit would likely be the means for selling an assortment of divider sheets for use with one or more book projects.

A single kit may contain divider sheets and insert sheets made and adapted for a variety of different applications, including a selected number of tab banks, for example, five, six, eight or any other number.

Exemplary of a kit containing a set number of tab banks, one having six banks will be described. The kit contains six (or some multiple of six) scored, folded and slotted divider sheets 4. For ease of explanation the plurality of positions of the six index tabs and the corresponding divider sheet slits 12 will be identified as positions A–F, with the top of the page index tab, or slit, being referred to as A, the middle index tab position identified as C and the bottom of the page index tab position and corresponding divider sheet slit identified as F.

For each set of six divider sheets 4 there are six insert sheets 20*a* (FIGS. 6 and 8*a*), each having an extended index tab 30 along the tab edge 22. The insert sheets have a maximum width of 8½ inches, as measured in a direction parallel to the tab edge 22. Although six tab positions are required, only three different configurations of insert sheets are necessary, as shown in FIGS. 6 and 8*a*. The six tab positions can be satisfied by providing two sets 40 and 41 of insert sheets. Each set comprises three insert sheets having tabs 30 in respective positions A, B and C. To fill the requirements of positions D, E and F, one set of the insert sheets can be turned over, as shown in FIG. 8*b* and by the dashed lines in FIG. 6.

The six divider sheets 4 can be configured in either of two ways. First, each sheet may contain three slits 12A, 12B and !2C, as shown in FIG. 7. To satisfactorily implement this configuration the length of the individual slits must be small enough to allow sufficient space between them to maintain the structural integrity of the divider sheet at the fold line. Individual insert sheets 20*a* are inserted into the folded divider sheets so that the tab 30A is inserted into slit 12A and tab 30B is inserted into a sheet having slit 12B etc., as shown in FIGS. 6 and 7. As shown by the dashed lines of FIGS. 6 and 7, inverted insert sheets 20*a* are inserted in inverted divider sheets 4 so that tab 30A is inserted into slit 12A, but fills position F. Likewise, the inverted insert and divider sheets are combined so that tab 30B is inserted into slit 12B, but fills position E.

Alternatively each sheet may contain only one slit 12, with three sheets containing slits in positions A, B and C respectively. If the index tabs are long, the second alternative of providing one slit per divider sheet is preferable. For the six bank model being described there may be six sheets each containing slits 12A, 12B and 12C. In the single slit alternative there are two sets 50 and 51 of three divider sheets, each of the three containing one slit in positions A, B and C respectively, as seen in FIG. 9*a*. Three of the divider sheets comprising the second set 51 may be turned over for receiving inverted insert sheets having index tabs 30A, 30B and 30C for filling positions D, E and F, as shown in FIGS. 8*b* and 9*b*. That is, the inverted insert sheets 20*a* of FIG. 8*b* are introduced into the inverted divider sheets 4 of FIG. 9*b* to produce divider sheet assemblies 2 having index tabs in positions D, E and F.

In operation, if printing of the divider sheets is desired, the printing is accomplished prior to placement of the insert sheets and index tabs into the folded divider sheet. The index tabs on the insert sheets are also printed before assembly. Following the printing operations, each insert sheet is placed within the folded halves of a divider sheet with its index tab inserted into the appropriate slit in the fold of the divider sheet. If the divider sheet assembly is to be bound or placed in a ring binder, the appropriate punching of binding holes is made as the last step in the assembly process.

In the kit, both the divider sheets and the insert sheets may be pre-punched for use with a three-ring notebook, as shown in FIGS. 6 and 7.

What is claimed is:

1. A tabbed index divider assembly comprising, a folded rectangular divider sheet having length and width dimensions where the length dimension is greater than the width dimension and where the sheet is folded along a line that bisects the length dimension, forming a folded outside edge and dual binding edges and having at least one slit in the folded edge, and an insert sheet having mutually parallel tab and binding edges, with the distance there between defining a length dimension that is equal to the dimension of the folded divider sheet from its folded outside edge to its binding edge, and having an index tab extending from the tab edge, and where the width dimension of the insert sheet, measured in a direction parallel to the binding edge, is not greater than one half of the length dimension of the divider sheet, said insert sheet adapted to be disposed between the folded halves of the divider sheet with the index tab inserted through the at least one slit in the folded edge of the divider sheet.

2. A kit for assembling a plurality of tabbed index dividers, comprising, a plurality of foldable rectangular divider sheets each having length and width dimensions where the length dimension is greater than the width dimension and where each sheet is foldable along a line that bisects the length dimension, forming a folded outside edge and dual binding edges and having at least one slit in the folded edge, and a plurality of rectangular insert sheets each having mutually parallel tab and binding edges, with the distance therebetween defining a length dimension that is equal to the dimension of the folded divider sheets from their respective outside edges to their respective binding edges, and each insert sheet having an index tab extending from the tab edge, and where the width dimension of each insert sheet, measured in a direction parallel to the respective sheet's binding edge, is not greater than one half of the length dimension of the divider sheets, each insert sheet adapted to be disposed between the folded halves of one of the plurality of divider sheets with the respective index tab inserted through the at least one slit in the folded edge of one of the plurality of divider sheets.

3. The kit of claim 2 where the plurality of divider sheets comprises sheets each having a single slit in their respective folded edges where the position of the respective slit is staggered from the position of the slits in the other of the plurality of divider sheets.

4. The kit of claim 2 where the plurality of insert sheets includes sheets that are each provided with a plurality of tabs that are staggered in their positions along the tab edges of the respective sheets.

5. The method of constructing an index divider sheet comprising the steps, scoring a first sheet along a line that bisects its length, cutting at least one slit in the first sheet along the scoring line, folding the first sheet along the scored fold line so that the folded halves of the sheet come together in a facing relation forming an index divider sheet that includes an outside folded edge and dual binding edges, inserting, between the folded halves of the first sheet, a second sheet having a binding edge and a tab edge with an extended index tab, inserting the extended tab through the at least one slit in the first sheet, and binding the dual binding edges of the first sheet together with the binding edge of the second sheet.

6. The method of claim 5 where the step of securing the second sheet includes attaching the second sheet to one of the folded halves of the first sheet with adhesive.

7. A tabbed index divider assembly comprising, a folded sheet divider having rectangular length and width dimensions where the sheet is folded along a line that bisects the length dimension, forming a folded outside edge, top and bottom edges and dual binding edges and having at least one slit in the folded outside edge, and an insert sheet having, mutually parallel binding and tab edges, an index tab extending from the tab edge and sized to be inserted in the at least one slit in the folded outside edge of the divider, said insert sheet sized and adapted to be secured between the folded halves of the divider by common binding along its binding edge with the dual binding edges of the divider.

8. The divider assembly of claim 7 where the dimension of the second sheet taken in the direction of the parallel binding and tab edges is not greater than one half of the length of the first sheet.

9. The method of constructing an index divider assembly comprising the steps of, folding a first rectangular sheet along a line that bisects its length so that the folded halves of the first sheet come together in facing congruent relation, forming a divider having top and bottom edges, an outside folded edge and dual binding edges, cutting at least one slit in the first sheet along the folded edge, inserting through the dual binding edges of the divider a second sheet having a binding edge and a parallel tab edge with an index tab extending therefrom, said insertion causing the second sheet to be disposed between the folded halves of the first sheet, inserting the extended index tab through the at least one slit in the first sheet, and securing the second sheet within the divider by common binding of the binding edge of the second sheet with the dual binding edges of the divider.

10. A tabbed index divider assembly comprising, a folded divider sheet having length and width dimensions where the sheet is folded along a line that bisects the length dimension, forming a folded outside edge and dual binding edges and having at least one slit in the folded outside edge, and an insert sheet having, a tab edge with an index tab extending therefrom, and a binding edge parallel with the tab edge and spaced therefrom a distance of one half of the length of the divider sheet, said insert sheet sized and adapted to be commonly bound with the dual binding edges of the divider sheet with the index tab inserted through the at least one slit in the folded outside edge of the divider sheet.

11. A tabbed index divider assembly comprising, a folded divider sheet having length and width dimensions where the sheet is folded along a line that bisects the length dimension, forming a folded outside edge and dual binding edges and having at least one slit in the folded outside edge, and an insert sheet having, a tab edge with an index tab extending therefrom, and a binding edge parallel with the tab edge and spaced therefrom a distance of one half of the length of the divider sheet, said insert sheet sized and adapted to be commonly bound with the dual binding edges of the divider sheet with the index tab inserted through the at least one slit in the folded outside edge of the divider sheet.

12. The assembly of claim 11 where the width dimension of the insert sheet, measured in a direction parallel to the binding edge, is not greater than one half of the length dimension of the divider sheet.

13. A tabbed index divider assembly comprising, a folded divider sheet having length and width dimensions where the sheet is folded along a line that bisects the length dimension, forming a folded outside edge and dual binding edges and having at least one slit in the folded outside edge, and a tab sheet having length and width dimensions disposed between the folded halves of the divider sheet and having, a tab edge with an index tab extending therefrom and through the at least one slit, a binding edge parallel with the tab edge and spaced therefrom by the length dimension of the tab sheet and where the binding edge is aligned with the dual binding edges of the divider sheet.

14. The assembly of claim 13 where the width of the tab sheet is less than the width of the divider sheet.

15. The assembly of claim 14 where the width of the tab sheet is not greater than the bisected length of the divider sheet.

* * * * *